US009359868B2

(12) United States Patent
Scott

(10) Patent No.: US 9,359,868 B2
(45) Date of Patent: Jun. 7, 2016

(54) RECOVERY FROM A SUBSURFACE HYDROCARBON RESERVOIR

(71) Applicant: George R Scott, Calgary (CA)

(72) Inventor: George R Scott, Calgary (CA)

(73) Assignee: ExxonMobil Upstream Research Company, Spring, TX (US)

( * ) Notice: Subject to any disclaimer, the term of this patent is extended or adjusted under 35 U.S.C. 154(b) by 487 days.

(21) Appl. No.: 13/888,696

(22) Filed: May 7, 2013

(65) Prior Publication Data

US 2013/0341018 A1 Dec. 26, 2013

(30) Foreign Application Priority Data

Jun. 22, 2012 (CA) ..... 2780670

(51) Int. Cl.
*E21B 36/00* (2006.01)
*E21B 43/24* (2006.01)

(52) U.S. Cl.
CPC ..... *E21B 36/001* (2013.01); *E21B 43/2406* (2013.01); *E21B 43/2408* (2013.01)

(58) Field of Classification Search
CPC E21B 36/001; E21B 43/2408; E21B 43/2406
See application file for complete search history.

(56) References Cited

U.S. PATENT DOCUMENTS

| | | | | |
|---|---|---|---|---|
| 3,292,702 | A | 12/1966 | Boberg et al. | 166/40 |
| 3,705,625 | A | 12/1972 | Whitten et al. | 166/252 |
| 3,739,852 | A | 6/1973 | Woods et al. | 166/303 |
| 3,872,924 | A | 3/1975 | Clampitt | 166/261 |
| 4,280,559 | A | 7/1981 | Best | 166/303 |
| 4,344,485 | A | 8/1982 | Butler | 166/271 |
| 4,397,612 | A | 8/1983 | Kalina | 417/54 |
| 4,519,454 | A | 5/1985 | McMillen | 166/303 |
| 4,697,642 | A | 10/1987 | Vogel | 166/263 |
| 4,773,257 | A | 9/1988 | Aselsen et al. | 73/61.1 |
| 4,776,170 | A | 10/1988 | Blangetti | 60/689 |
| 4,948,393 | A | 8/1990 | Hodson et al. | 55/40 |
| 5,141,054 | A | 8/1992 | Alameddine et al. | 166/252 |
| 5,215,146 | A | 6/1993 | Sanchez | 166/263 |
| 5,289,881 | A | 3/1994 | Schuh | 166/303 |

(Continued)

FOREIGN PATENT DOCUMENTS

| | | |
|---|---|---|
| CA | 1246993 | 12/1988 |
| CA | 1304287 | 6/1992 |

(Continued)

OTHER PUBLICATIONS

Barillas, J.L.M. et al. (2009) "Noncontinous Steam Injection Optimization for SAGD Process for Heavy Oil Recovering," SPE Latin Amer. and Caribbean Pet. Engin. Conf. Caragena. Columbia. SPE 122188, 9 pages.

(Continued)

*Primary Examiner* — Nicole Coy
(74) *Attorney, Agent, or Firm* — ExxonMobil Upstream Research Company Law Dept.

(57) ABSTRACT

Methods and systems for improving recovery from a subsurface hydrocarbon reservoir are described. A method includes drilling a horizontal well in a zone proximate to a contiguous section of cap rock over a reservoir interval. A refrigerant is flowed through the horizontal well to freeze water in the zone, forming a freeze wall in contact with the contiguous section of cap rock. A chamber is formed above the reservoir interval, wherein the chamber includes the contiguous section of cap rock and at least one freeze wall.

24 Claims, 8 Drawing Sheets

(56) References Cited

U.S. PATENT DOCUMENTS

| | | | | |
|---|---|---|---|---|
| 5,355,948 | A | 10/1994 | Sparlin et al. | 166/228 |
| 5,411,094 | A | 5/1995 | Northrop | 166/303 |
| 5,730,223 | A | 3/1998 | Restarick | 166/380 |
| 5,826,655 | A | 10/1998 | Snow et al. | 166/272.3 |
| 5,860,475 | A | 1/1999 | Ejiogu et al. | 166/245 |
| 5,899,274 | A | 5/1999 | Frauenfeld et al. | 166/401 |
| 5,957,205 | A | 9/1999 | Bohme et al. | 166/296 |
| 6,158,510 | A | 12/2000 | Bacon et al. | 166/272.7 |
| 6,230,814 | B1 | 5/2001 | Nasr et al. | 166/400 |
| 6,257,334 | B1 | 7/2001 | Cyr et al. | 166/272.7 |
| 6,259,165 | B1 | 7/2001 | Brewington | 290/1 A |
| 6,662,872 | B2 | 12/2003 | Gutek et al. | 166/272.4 |
| 6,708,759 | B2 | 3/2004 | Leaute et al. | 166/272.4 |
| 6,769,486 | B2 | 8/2004 | Lim et al. | 166/263 |
| 6,854,929 | B2 * | 2/2005 | Vinegar | B09C 1/00 405/128.4 |
| 7,500,528 | B2 * | 3/2009 | McKinzie, II | C07C 4/02 166/302 |
| 7,510,000 | B2 * | 3/2009 | Pastor-Sanz | E21B 36/04 166/302 |
| 7,520,325 | B2 | 4/2009 | Hocking | 166/259 |
| 7,556,099 | B2 | 7/2009 | Arthur et al. | 166/272.3 |
| 7,591,309 | B2 | 9/2009 | Minnich et al. | 166/266 |
| 7,591,311 | B2 | 9/2009 | Minnich et al. | 166/272.3 |
| 7,900,701 | B2 | 3/2011 | Weiers et al. | 166/251.1 |
| 7,931,083 | B2 | 4/2011 | Betzer-Tsilevich | 166/272.3 |
| 7,984,759 | B2 | 7/2011 | Ayasse | 166/261 |
| 8,118,096 | B2 | 2/2012 | Ayasse | 166/261 |
| 9,127,523 | B2 * | 9/2015 | Deeg | E21B 36/001 |
| 2009/0133643 | A1 | 5/2009 | Suggett et al. | 122/1 B |
| 2009/0159277 | A1 | 6/2009 | Hocking | 166/259 |
| 2009/0288827 | A1 | 11/2009 | Coskuner | 166/272.3 |
| 2010/0206565 | A1 | 8/2010 | Embry et al. | 166/272.3 |
| 2010/0294488 | A1 | 11/2010 | Wheeler et al. | 166/248 |
| 2011/0120709 | A1 | 5/2011 | Nast et al. | 166/272.3 |
| 2011/0120717 | A1 | 5/2011 | LaMont et al. | 166/305.1 |
| 2011/0186295 | A1 | 8/2011 | Kaminsky et al. | 166/302 |
| 2012/0085537 | A1 | 4/2012 | Banerjee et al. | 166/272.3 |
| 2013/0025861 | A1 * | 1/2013 | Kift | E21B 43/16 166/279 |
| 2013/0206405 | A1 * | 8/2013 | Kift | E21B 43/20 166/268 |

FOREIGN PATENT DOCUMENTS

| | | |
|---|---|---|
| CA | 2241478 | 12/1999 |
| CA | 2299790 | 8/2001 |
| CA | 2243105 | 11/2001 |
| CA | 2277378 | 9/2002 |
| CA | 2251157 | 5/2003 |
| CA | 2463110 | 5/2003 |
| CA | 2219513 | 6/2003 |
| CA | 2323029 | 3/2004 |
| CA | 2313837 | 9/2004 |
| CA | 2494391 | 7/2006 |
| CA | 2594413 | 7/2006 |
| CA | 2584712 | 10/2008 |
| CA | 2591498 | 2/2010 |
| CA | 2641294 | 4/2010 |
| CA | 2621991 | 9/2010 |
| CA | 2697417 | 9/2010 |
| CA | 2710078 | 1/2011 |
| CA | 2684049 | 4/2011 |
| CA | 2698898 | 7/2011 |
| CA | 2714646 | 3/2012 |
| CA | 2769356 | 8/2012 |
| EP | 0786577 | 7/1997 |
| WO | WO99/67503 | 12/1999 |
| WO | WO2007/050180 | 5/2007 |
| WO | WO2009/105309 | 8/2009 |
| WO | WO2012/037147 | 3/2012 |

OTHER PUBLICATIONS

Butler, et al., (1991) "A New Process (Vapex) for Recovering Heavy Oils," JCPT, vol. 30, No. 1, pp. 97-106.

Davies, D. K. et al. (1997) "A Novel, Low Cost, Well Completion Technique Using Steam for Formations With Unconsolidated Sands, Wilmington Field, California," SPE Ann. Tech. Conf. San Antonio, Texas, SPE 38793, pp. 433-447.

Donnelly (1999) "Hilda Lake a Gravity Drainage Success," *SPE Int'l Thermal Operations and Heavy Oil Symposium*. Bakersfield. CA, SPE 54093, 7 pages.

Edie et al. (2003) "Meander Belt Entrapment of Hydrocarbons at Saddle Lake, Alberta and an Untested In Situ Combustion Scheme for Recovery of Heavy Oil," *Bulletin of Canadian Petroleum Geology*. v. 51, No. 3, pp. 253-274.

Granger, M. J. et al. (1996) "Horizontal Well Applications in the Guymon-Hugoton Field: A Case Study," *Gas Tech. Conf*, Calgary, Alberta, Canada, SPE 35641, pp. 1-10.

Harrison, Lynda (2012) "Cenovus Seeks Use of Oil Sands Start-Up Boosting Technologies," *New Technology Magazine*, Mar. 1, 2012, 2 pgs.

Kisman, et al. (1995) "Numerical Simulation of the SAGD Process in the Burnt Lake Oil Sands Lease," *SPE Int'l Heavy Oil Symposium*. Calgary. Alberta, SPE 30276, pp. 275-286.

Montgomery, S. L. (1998) "Increasing Reserves in a Mature Giant: Wilmington Field Los Angeles Basin, Part II: Improving Heavy Oil Production Through Advanced Reservoir Characterization and Innovative Thermal Technologies," *AAPG Bulletin*, v. 82, No. 4, pp. 531-544.

Nguyen, H. X. et al. (2012) "Successful Application of Discontinuous SAGD Technique to Maximize Oil Recovery in Alberta's Oil Sands," *SPE Heavy Oil Conf.*, Calgary, AB. CA. SPE 157866, 15 pages.

Nelson et al. (1961) "How to Engineer an In Situ Combustion Project," *The Oil and Gas Journal*, p. 58.

Butler, R. M. (1997) "Thermal Recovery of Oil and Bitumen," *Prentice Hall*, pp. 285-359.

* cited by examiner

100

200

300

400

500

600

700

800

RECOVERY FROM A SUBSURFACE HYDROCARBON RESERVOIR

CROSS-REFERENCE TO RELATED APPLICATIONS

This application claims the benefit of Canadian patent application number 2,780,670 filed on Jun. 22, 2012 entitled IMPROVING RECOVERY FROM A SUBSURFACE HYDROCARBON RESERVOIR, the entirety of which is incorporated herein.

FIELD

The present techniques relate to isolating hydrocarbon reservoirs from surrounding zones. Specifically, techniques are disclosed for using freeze walls to prevent flow from one zone to another.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Modern society is greatly dependent on the use of hydrocarbons for fuels and chemical feedstocks. Hydrocarbons are generally found in subsurface rock formations that can be termed "reservoirs." Removing hydrocarbons from the reservoirs depends on numerous physical properties of the rock formations, such as the permeability of the rock containing the hydrocarbons, the ability of the hydrocarbons to flow through the rock formations, and the proportion of hydrocarbons present, among others.

Easily harvested sources of hydrocarbon are dwindling, leaving less accessible sources to satisfy future energy needs. However, as the costs of hydrocarbons increase, these less accessible sources become more economically attractive. For example, the harvesting of oil sands to remove hydrocarbons has become more extensive as it has become more economical. The hydrocarbons harvested from these reservoirs may have relatively high viscosities, for example, ranging from 8 API, or lower, up to 20 API, or higher. Accordingly, the hydrocarbons may include heavy oils, bitumen, or other carbonaceous materials, collectively referred to herein as "heavy oil," which are difficult to recover using standard techniques.

Several methods have been developed to remove hydrocarbons from oil sands. For example, strip or surface mining may be performed to access the oil sands, which can then be treated with hot water or steam to extract the oil. However, deeper formations may not be accessible using a strip mining approach. For these formations, a well can be drilled to the reservoir and steam, hot air, solvents, or combinations thereof, can be injected to release the hydrocarbons. The released hydrocarbons may then be collected by the injection well or by other wells and brought to the surface.

A number of techniques have been developed for harvesting heavy oil from subsurface formations using thermal recovery techniques. Thermal recovery operations are used around the world to recover liquid hydrocarbons from both sandstone and carbonate reservoirs. These operations include a suite of steam based in situ thermal recovery techniques, such as cyclic steam stimulation (CSS), steam flooding, and steam assisted gravity drainage (SAGD).

For example, CSS techniques includes a number of enhanced recovery methods for harvesting heavy oil from formations that use steam heat to lower the viscosity of the heavy oil. The steam is injected into the reservoir through a well and raises the temperature of the heavy oil during a heat soak phase, lowering the viscosity of the heavy oil. The same well may then be used to produce heavy oil from the formation. Solvents may be used in combination with steam in CSS processes, such as in mixtures with the steam or in alternate injections between steam injections. These techniques are described in U.S. Pat. No. 4,280,559 to Best, U.S. Pat. No. 4,519,454 to McMillen, and U.S. Pat. No. 4,697,642 to Vogel, among others.

Another group of techniques is based on a continuous injection of steam through a first well to lower the viscosity of heavy oils and a continuous production of the heavy oil from a lower-lying second well. Such techniques may be termed "steam assisted gravity drainage" or SAGD. Various embodiments of the SAGD process are described in Canadian Patent No. 1,304,287 to Butler and its corresponding U.S. Pat. No. 4,344,485.

In SAGD, two horizontal wells are completed into the reservoir. The two wells are first drilled vertically to different depths within the reservoir. Thereafter, using directional drilling technology, the two wells are extended in the horizontal direction that result in two horizontal wells, vertically spaced from, but otherwise vertically aligned with the other. Ideally, the production well is located above the base of the reservoir but as close as practical to the bottom of the reservoir, and the injection well is located vertically 10 to 30 feet (3 to 10 meters) above the horizontal well used for production.

The upper horizontal well is utilized as an injection well and is supplied with steam from the surface. The steam rises from the injection well, permeating the reservoir to form a vapor chamber that grows over time towards the top of the reservoir, thereby increasing the temperature within the reservoir. The steam, and its condensate, raise the temperature of the reservoir and consequently reduce the viscosity of the heavy oil in the reservoir. The heavy oil and condensed steam will then drain downward through the reservoir under the action of gravity and may flow into the lower production well, whereby these liquids can be pumped to the surface. At the surface of the well, the condensed steam and heavy oil are separated, and the heavy oil may be diluted with appropriate light hydrocarbons for transport by pipeline.

The efficacy of harvesting of hydrocarbons from the oil sand reservoir depends on the maintenance of temperature to mobilize the hydrocarbons. The loss of steam pressure, for example, through permeable, fractured, or eroded sections of an overlying rock segment, or cap rock, will lower the pressure, lowering the temperature. Further, the lost steam may reach the surface, creating additional regulatory issues. Conversely, the influx of water through permeable, fractures or eroded sections would cause the steam chamber to collapse, effectively ending the SAGD process.

Various techniques have been used to form barriers to fluid flow, for example, in areas with missing cap rock formations. For example, US Patent Application Publication No. 2011/0186295, by Kaminsky, discloses a method for recovering viscous oil such as bitumen from a subsurface formation. An artificial barrier that is largely impermeable to fluid flow is created in a subterranean zone above or proximate to a top of the subsurface formation. The viscosity of the viscous oil and mobilizing hydrocarbons is reduced to form a readily flowable heavy oil by addition of heat and/or solvent. Heating preferably uses a plurality of heat injection wells. The heavy oil is produced using a production method that preserves the integrity of the artificial barrier.

As another example, in an application for a statutory consent test run to the Energy Resources Conservation Board (ERCB) of Canada, Cenovus requested permission to test a dewatering application to form an air barrier to isolate an aquifer overlying a hydrocarbon field. See ERCB, application Ser. No. 1,689,991 (Jun. 9, 2011). The test will use four lower horizontal wells arranged as a square to produce water from a region of the aquifer. Another horizontal well, located above and central to the four wells, is used to inject air to replace the water. The produced water is reinjected in four horizontal wells, above and offset to the exterior of the four horizontal production wells, and offset from the air injection well. The Cenovus technique may isolate the hydrocarbon region from an offset interval of permeable cap rock, but may allow the loss of pressure from, or the influx of water into, the field under certain conditions, such as during a power loss.

Canadian Patent Application Publication No. 2,463,110 describes a method for inhibiting migration of fluids into and/or out of a treatment area undergoing an in situ conversion process. Barriers in the formation proximate a treatment area may be used to inhibit the migration of fluids. Inhibition of the migration of fluids may occur before, during, or after an in situ treatment process. For example, migration of fluids may be inhibited while heat is provided from heaters to at least a portion of the treatment area. Barriers may include naturally occurring portions (e.g., overburden, and/or underburden) and/or installed portions, such as frozen barrier zones, cooled by a refrigerant.

The references cited above, among others, describe the use of freeze walls proximate to hydrocarbon reservoirs to isolate hydrocarbons from other portions of the subsurface. However, none of the references describes the use of freeze walls to form a chamber above the hydrocarbon reservoir. Such a chamber may provide a mechanism for trapping a gas cap over the reservoir.

SUMMARY

An embodiment described herein provides a method for improving recovery from a subsurface hydrocarbon reservoir. The method includes drilling a horizontal well in a zone proximate to a contiguous section of cap rock over a reservoir interval. A refrigerant is flowed through the horizontal well to freeze water in the zone, forming a freeze wall in contact with the contiguous section of cap rock. A chamber is formed above the reservoir interval, wherein the chamber includes the contiguous section of cap rock and at least one freeze wall.

Another embodiment described herein provides a system for improving the recovery of resources from a reservoir. The system includes a horizontal well drilled proximate to a contiguous region of a cap rock and a coolant system configured to circulate a coolant through the horizontal well. The temperature of the coolant is selected to freeze water in the vicinity of the horizontal well, forming a freeze wall. The freeze wall is in contact with the contiguous region of the cap rock and the freeze wall and cap rock isolate a chamber above the reservoir from a permeable section of the cap rock.

Another embodiment described herein provides a method for harvesting hydrocarbons from an oil sands reservoir. The method includes drilling a horizontal well proximate to an impermeable section of a cap rock over the oil sand reservoir. A refrigerant is flowed through the horizontal well to freeze water proximate to the horizontal well, forming a freeze wall in contact with the impermeable section of the cap rock, wherein the freeze wall isolates a permeable section of the cap rock from the impermeable section of the cap rock. A gas is flowed into a chamber formed by the cap rock and the freeze wall to displace water from the chamber. At least one well is drilled through the oil sands reservoir. Steam is injected into the oil sands reservoir and fluids are produced from the oil sands reservoir.

DESCRIPTION OF THE DRAWINGS

The advantages of the present techniques are better understood by referring to the following detailed description and the attached drawings, in which.

DETAILED DESCRIPTION

Figure 1:
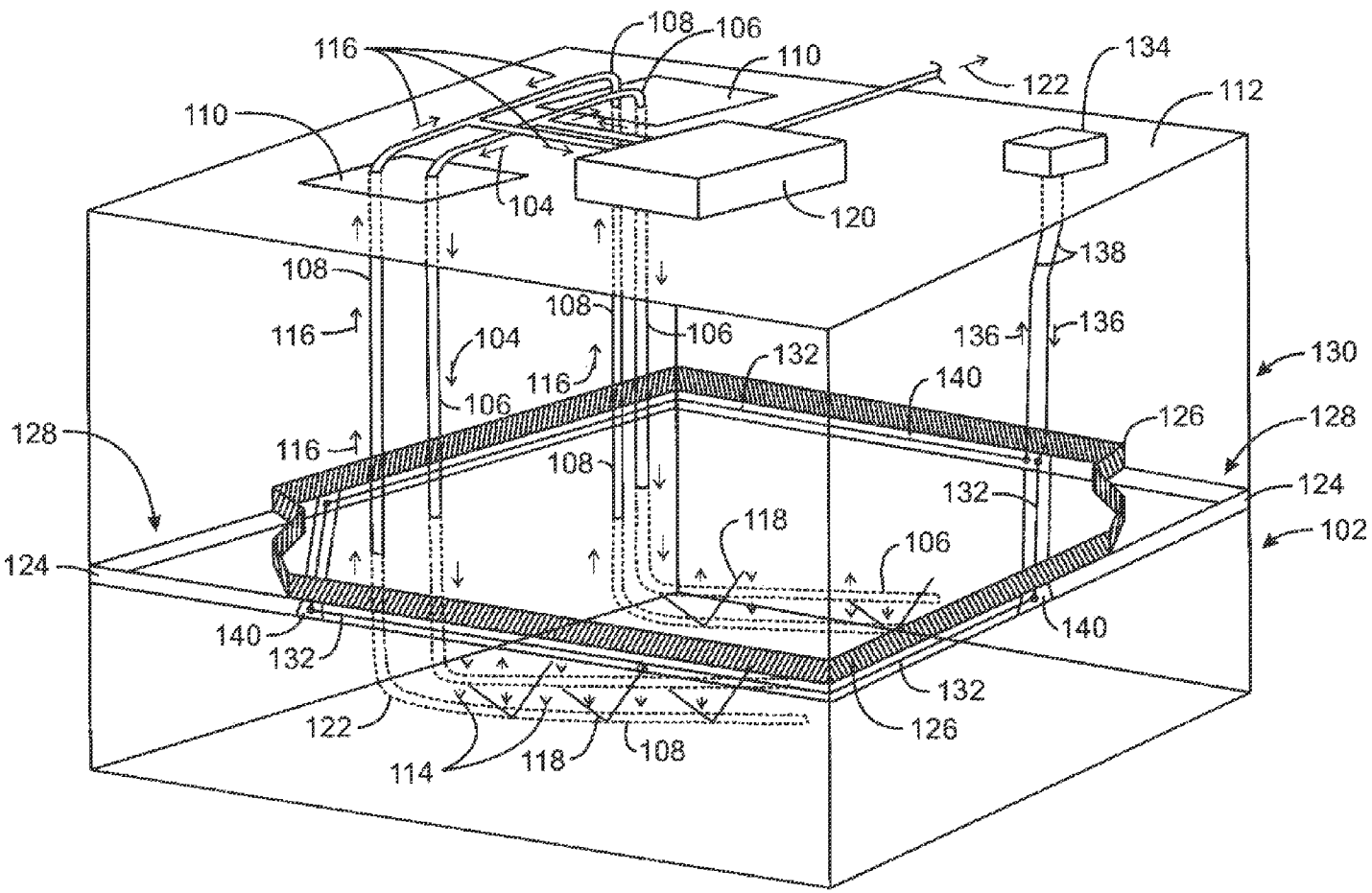
FIG. 1 is a drawing of a steam assisted gravity drainage (SAGD) process used for accessing hydrocarbon resources in a reservoir.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the term "base" indicates a lower boundary of the resources in a reservoir that are practically recoverable, by a gravity-assisted drainage technique, for example, using an injected mobilizing fluid, such as steam, solvents, hot water, gas, and the like. The base may be considered a lower boundary of the payzone. The lower boundary may be an impermeable rock layer, including, for example, granite, limestone, sandstone, shale, and the like. The lower boundary may also include layers that, while not impermeable, impede the formation of fluid communication between a well on one side and a well on the other side.

"Bitumen" is a naturally occurring heavy oil material. Generally, it is the hydrocarbon component found in oil sands. Bitumen can vary in composition depending upon the degree of loss of more volatile components. It can vary from a very viscous, tar-like, semi-solid material to solid forms. The hydrocarbon types found in bitumen can include aliphatics, aromatics, resins, and asphaltenes. A typical bitumen might be composed of:

19 wt. % aliphatics (which can range from 5 wt. %-30 wt. %, or higher);

19 wt. % asphaltenes (which can range from 5 wt. %-30 wt. %, or higher);

30 wt. % aromatics (which can range from 15 wt. %-50 wt. %, or higher);

32 wt. % resins (which can range from 15 wt. %-50 wt. %, or higher); and some amount of sulfur (which can range in excess of 7 wt. %).

In addition bitumen can contain some water and nitrogen compounds ranging from less than 0.4 wt. % to in excess of 0.7 wt. %. The percentage of the hydrocarbon types found in bitumen can vary. As used herein, the term "heavy oil" includes bitumen, as well as lighter materials that may be found in a sand or carbonate reservoir.

As used herein, two locations in a reservoir are in "fluid communication" when a path for fluid flow exists between the locations. For example, the establish of fluid communication between a lower-lying production well and a higher injection well may allow material mobilized from a steam chamber above the injection well to flow down to the production well for collection and production. As used herein, a fluid includes a gas or a liquid and may include, for example, a produced hydrocarbon, an injected mobilizing fluid, or water, among other materials.

As used herein, the term "cap rock" indicates a upper boundary of the resources in a reservoir that are practically recoverable, by a gravity-assisted drainage technique, for example, using an injected mobilizing fluid, such as steam, solvents, hot water, gas, and the like. The cap rock may be located immediately above the payzone, or may be located above an aquifer, a gas zone, or both a gas zone and aquifer that are adjacent to the upper boundary of the payzone. The cap rock is generally an impermeable rock layer that prevents loss of pressure from the payzone into the overlying layers of the subsurface. The impermeable rock layer may include, for example, granite, limestone, sandstone, shale, and the like. In some cases, erosion, deposition, or other processes may result in an incomplete or permeable cap rock layer, which can complicate the harvesting of hydrocarbons from the underlying reservoir.

As used herein, a "cyclic recovery process" uses an intermittent injection of a mobilizing fluid selected to lower the viscosity of heavy oil in a hydrocarbon reservoir. The injected mobilizing fluid may include steam, solvents, gas, water, or any combinations thereof. After a soak period, intended to allow the injected material to interact with the heavy oil in the reservoir, the material in the reservoir, including the mobilized heavy oil and some portion of the mobilizing agent may be harvested from the reservoir. Cyclic recovery processes use multiple recovery mechanisms, in addition to gravity drainage, early in the life of the process. The significance of these additional recovery mechanisms, for example dilation and compaction, solution gas drive, water flashing, and the like, declines as the recovery process matures. Practically speaking, gravity drainage is the dominant recovery mechanism in all mature thermal, thermal-solvent and solvent based recovery processes used to develop heavy oil and bitumen deposits. For this reason the approaches disclosed here are equally applicable to all recovery processes in which at the current stage of depletion gravity drainage is the dominant recovery mechanism.

"Facility" as used in this description is a tangible piece of physical equipment through which hydrocarbon fluids are either produced from a reservoir or injected into a reservoir, or equipment which can be used to control production or completion operations. In its broadest sense, the term facility is applied to any equipment that may be present along the flow path between a reservoir and its delivery outlets. Facilities may comprise production wells, injection wells, well tubulars, wellhead equipment, gathering lines, manifolds, pumps, compressors, separators, surface flow lines, steam generation plants, processing plants, and delivery outlets. In some instances, the term "surface facility" is used to distinguish those facilities other than wells.

"Heavy oil" includes oils which are classified by the American Petroleum Institute (API), as heavy oils, extra heavy oils, or bitumens. In general, a heavy oil has an API gravity between 22.3° (density of 920 kg/m$^3$ or 0.920 g/cm$^3$) and 10.0° (density of 1,000 kg/m$^3$ or 1 g/cm$^3$). An extra heavy oil, in general, has an API gravity of less than 10.0° (density greater than 1,000 kg/m$^3$ or greater than 1 g/cm$^3$). For example, a source of heavy oil includes oil sand or bituminous sand, which is a combination of clay, sand, water, and bitumen. The recovery of heavy oils is based on the viscosity decrease of fluids with increasing temperature or solvent concentration. Once the viscosity is reduced, the mobilization of fluids by steam, hot water flooding, or gravity is possible. The reduced viscosity makes the drainage quicker and therefore directly contributes to the recovery rate.

A "hydrocarbon" is an organic compound that primarily includes the elements hydrogen and carbon, although nitrogen, sulfur, oxygen, metals, or any number of other elements may be present in small amounts. As used herein, hydrocarbons generally refer to components found in heavy oil, or other oil sands.

"Permeability" is the capacity of a rock to transmit fluids through the interconnected pore spaces of the rock. The customary unit of measurement for permeability is the millidarcy. As used herein, permeability is also used to describe subsurface soil and rock layers that have higher fluid conductivities, for example, due to fractures, erosion, and the like.

"Pressure" is the force exerted per unit area by the gas on the walls of the volume. Pressure can be shown as pounds per square inch (psi). "Atmospheric pressure" refers to the local pressure of the air. "Absolute pressure" (psia) refers to the sum of the atmospheric pressure (14.7 psia at standard conditions) plus the gauge pressure (psig). "Gauge pressure" (psig) refers to the pressure measured by a gauge, which indicates only the pressure exceeding the local atmospheric pressure (i.e., a gauge pressure of 0 psig corresponds to an absolute pressure of 14.7 psia). The term "vapor pressure" has the usual thermodynamic meaning.

As used herein, a "reservoir" is a subsurface rock or sand formation from which a production fluid, or resource, can be harvested. The rock formation may include sand, granite, silica, carbonates, clays, and organic matter, such as bitumen, heavy oil, oil, gas, or coal, among others. Reservoirs can vary in thickness from less than one foot (0.3048 m) to hundreds of feet (hundreds of m). The resource is generally a hydrocarbon, such as a heavy oil impregnated into a sand bed.

As discussed in detail above, "Steam Assisted Gravity Drainage" (SAGD), is a thermal recovery process in which steam, or combinations of steam and solvents, is injected into a first well to lower a viscosity of a heavy oil, and fluids are recovered from a second well. Both wells are generally horizontal in the formation and the first well lies above the second well. Accordingly, the reduced viscosity heavy oil flows down to the second well under the force of gravity, although pressure differential may provide some driving force in various applications. Although SAGD is used as an exemplary process herein, it can be understood that the techniques described can include any gravity driven process, such as those based on steam, solvents, or any combinations thereof.

"Substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context.

As used herein, "thermal recovery processes" include any type of hydrocarbon recovery process that uses a heat source to enhance the recovery, for example, by lowering the viscosity of a hydrocarbon. These processes may use injected mobilizing fluids, such as hot water, wet steam, dry steam, or solvents alone, or in any combinations, to lower the viscosity of the hydrocarbon. Such processes may include subsurface processes, such as cyclic steam stimulation (CSS), cyclic solvent stimulation, steam flooding, solvent injection, and SAGD, among others, and processes that use surface processing for the recovery, such as sub-surface mining and surface mining. Any of the processes referred to herein, such as SAGD, may be used in concert with solvents.

As used herein, "water" encompasses both fresh and brackish (or salty) water. The mineral content of the water will influence the refrigeration requirements, but should not preclude its use. If the mineral content of the water causes a substantial freezing point depression, for example, −5° C., −10° C., −15° C. or lower, fresh water may be injected to displace the high mineral content water away from a freeze wall construction area. Further, a double wall may be created in which fresh water is maintained between the walls, at a slightly higher pressure, to allow the fresh water to flow into any cracks in the wall and thereby refreeze it.

A "well" is a hole in the subsurface made by drilling or inserting a conduit into the subsurface. A well may have a substantially circular cross section or any other cross-sectional shape, such as an oval, a square, a rectangle, a triangle, or other regular or irregular shapes. As used herein, the term "wellbore," when referring to an opening in the formation, may be used interchangeably with the term "well."

Overview

Steam assisted gravity drainage processes, and other hydrocarbon recovery processes that use an injected mobilizing fluid, are often conducted at pressures that may lead to the leak off of fluids to surrounding layers. Thus, an important consideration in the implementation of these techniques is the presence of an intact layer of rock above the reservoir, which is termed herein the "cap rock" or "top seal." The cap rock holds the pressure in the reservoir, which, in the case of SAGD, allows the maintenance of temperature sufficient to mobilize the heavy oils.

Accordingly, reservoirs that have a permeable or missing cap rock layer, for example, due to erosion, uneven deposition processes, fractures, and the like, may be difficult to harvest with SAGD, or other techniques that maintain a pressure in the formation. The techniques described herein isolate areas where a top seal exists from areas where no top seal exists. The techniques involve drilling one or more horizontal wells in an aquifer that overlies the hydrocarbon reservoir, but is underneath the cap rock. The horizontal wells are located at the edge of a contiguous section of cap rock. A coolant is circulated through the horizontal wells to chill the water in the aquifer, thereby creating a freeze wall in contact with the cap rock. The freeze wall creates a chamber underneath the cap rock. This chamber may be filled with a gas to displace water, forming an insulation barrier underneath the cap rock, improving the efficiency of the process and protecting the freeze wall from melting due to heat from steam injected during the recovery process.

For the purposes of this description, SAGD is used as the recovery process. Those ordinarily skilled in the art will recognize that the approaches disclosed here are equally applicable to all thermal, thermal-solvent and solvent based recovery processes in which gravity drainage is the dominant recovery mechanism.

FIG. 1 is a drawing of a steam assisted gravity drainage (SAGD) process 100 used for accessing hydrocarbon resources in a reservoir 102. In the SAGD process 100, steam 104 can be injected through injection wells 106 to the reservoir 102. As previously noted, the injection wells 106 may be horizontally drilled through the reservoir 102. Production wells 108 may be drilled horizontally through the reservoir 102, with a production well 108 underlying each injection well 106. Generally, the injection wells 106 and production wells 108 will be drilled from the same pads 110 at the surface 112. This may make it easier for the production well 108 to track the injection well 106. However, in some embodiments the wells 106 and 108 may be drilled from different pads 110.

The injection of steam 104 into the injection wells 106 may result in the mobilization of hydrocarbons 114, which may drain to the production wells 108 and be removed to the surface 112 in a mixed stream 116 that can contain hydrocarbons, condensate and other materials, such as water, gases, and the like. Screen assemblies may be used on the injection wells 106, for example, to throttle the inflow of injectant vapor to the reservoir 102. Similarly, screen assemblies may be used on the production wells 108, for example, to decrease sand entrainment.

The hydrocarbons 114 may form a triangular shaped drainage chamber 118 that has the production well 108 at located at a lower apex. The mixed stream 116 from a number of production wells 108 may be combined and sent to a processing facility 120. At the processing facility 120, the water and hydrocarbons 122 can be separated, and the hydrocarbons 122 sent on for further refining. Water from the separation may be recycled to a steam generation unit within the facility 120, with or without further treatment, and used to generate the steam 104 used for the SAGD process 100.

An aquifer 124, which can be termed "top water," is often located above the reservoir 102, and may be separated from the reservoir 102 by a number of other layers in the subsurface (not shown). A layer of cap rock 126 may be located over or in the aquifer 124. The cap rock 126 can hold pressure in the reservoir 102, allowing the drainage chamber 118 to maintain pressure and, thus, temperature. However, the cap rock 126 may not be contiguous, but may have zones 128 where the cap rock 126 is missing or permeable, for example, due to erosion, uneven deposition, faulting, and the like.

These zones 128 may complicate the use of SAGD, or other techniques that use pressure, to harvest the hydrocarbons from the reservoir 102, by allowing the pressure to bleed off into the overlying layers 130. As described herein, one or more horizontal wells 132 may be drilled through the aquifer 124 underneath an edge of a contiguous section of the cap rock 126. The horizontal wells 132 may overly the reservoir 102, although, in the absence of an aquifer 124, the horizontal wells 132 may be drilled at the upper edge of the reservoir 102, adjacent to the cap rock 126.

A cooling system 134 at the surface 112 is used to circulate cooling fluids 136 through the horizontal wells 132, for example, through vertical wells 138 extending from the surface 112. The cooling fluids 136 can include any number of materials, such as glycol/water mixtures, brine solutions, ammonia, hydrofluorocarbons (HFCs), fluorocarbons (FCs), or any other suitable material. The vertical wells 138 may be insulated lines designed to limit the amount of heat exchanged with subsurface layers.

The circulation of the coolant 136 through the horizontal wells 132 in the aquifer 124 forms a freeze wall 140 in the aquifer 124. As the freeze wall 140 formed is in contact with the cap rock 126, it forms a chamber under the cap rock 126, as discussed further with respect to FIGS. 2-4. If no aquifer 124 is located between the cap rock 126 and the reservoir 102, water may be injected near the horizontal well 132 to form the freeze wall 140.

For simplicity, the horizontal wells 132 in the drawing are shown as a single contiguous segment overlying and extending completely around the reservoir 102. However, it can be understood that a number of individual horizontal wells can be used to form a contiguous freeze wall 140 to isolate a contiguous section of the cap rock 126 from a permeable zone 128.

Further, the freeze walls are not limited to the number and conformation shown in the drawing 100. For example, additional cooling wells can be drilled proximate to permeable regions, such as fractures, along the cap rock 126 to form frozen zones to seal these regions or reinforce weaker regions. These frozen zones may be located along the top of the cap rock 126 to lower the amount of heat in contact with the frozen zones. Further, freeze walls may be created across a single zone leading to permeable section of cap rock 126.

Formation of the Freeze Walls

Figure 2:
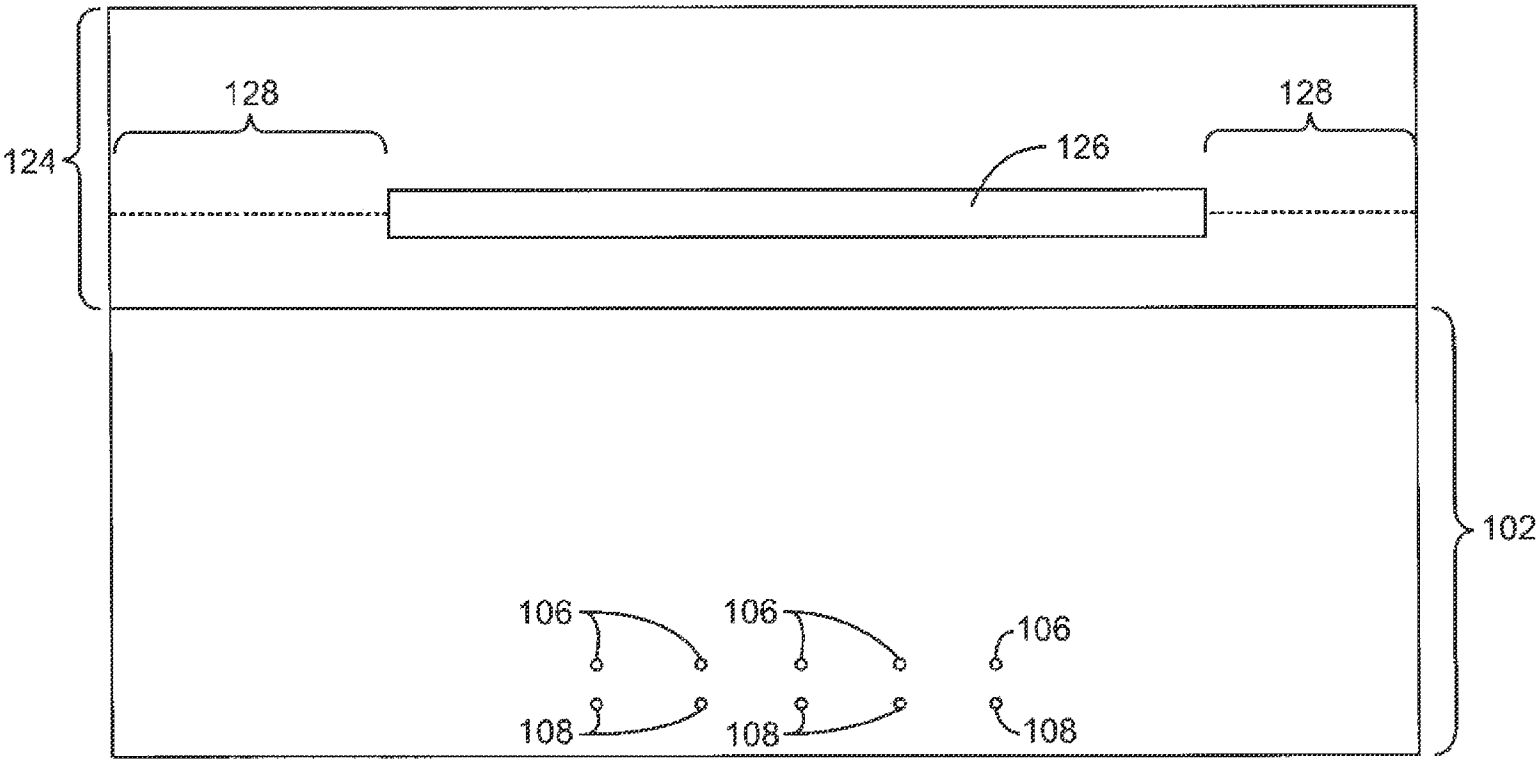
FIG. 2 is a cross sectional view of a hydrocarbon reservoir with zones in which the cap rock is missing.

FIG. 2 is a cross sectional view 200 of a hydrocarbon reservoir 102 with zones 128 in which the cap rock 126 is missing. Like numbered items are as discussed with respect to FIG. 1, e.g., in describing the aquifer 124, among others. As noted above, the zones 128 may complicate the use of SAGD wells 106 and 108 to harvest hydrocarbons from the reservoir 102 as they provide locations to bleed off pressure into the surrounding layers.

Figure 3:
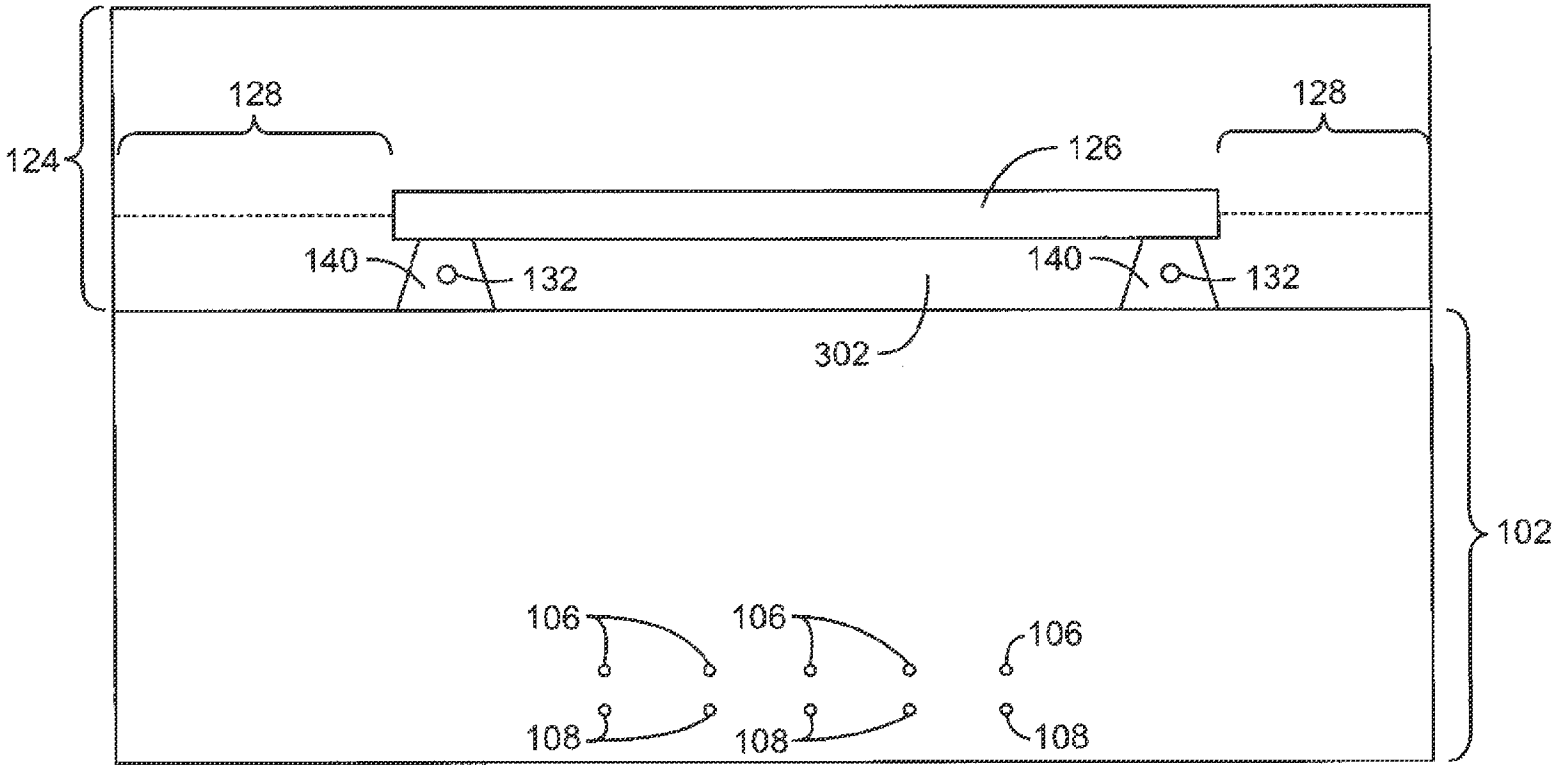
FIG. 3 is a cross sectional view of the hydrocarbon reservoir of FIG. 3 showing a freeze wall formed by flowing a coolant through the horizontal well.

FIG. 3 is a cross sectional view 300 of the hydrocarbon reservoir 102 of FIG. 3 showing a freeze wall 140 formed by flowing a coolant through a horizontal well 132 drilled under an edge of the cap rock 126. Like numbered items are as discussed with respect to FIGS. 1 and 2. The formation of the freeze wall 140 creates a chamber 302 under the cap rock 126. The chamber 302 may be filed with a gas to displace the water of the aquifer 124, insulating the freeze walls 140 from steam injected through the injection wells 106. For example, separate wells (not shown) may be drilled to the chamber to inject the gas and remove the water. Further, the gas has a much lower volumetric heat capacity than the water it replaces, improving the efficiency of the process. For this reason, the techniques described herein may also be useful in reservoirs that have an impermeable cap rock, e.g., in reservoirs having an aerially extensive top water zone, since the gas in the chamber 302 may lower the amount of steam needed to maintain a selected reservoir temperature.

The gas used to fill the chamber may include air, nitrogen, $CO_2$, or a light hydrocarbon, such as methane. The selection of the gas may be made on the basis of cost, availability, and reactivity with the hydrocarbons in the reservoir.

Figure 4:
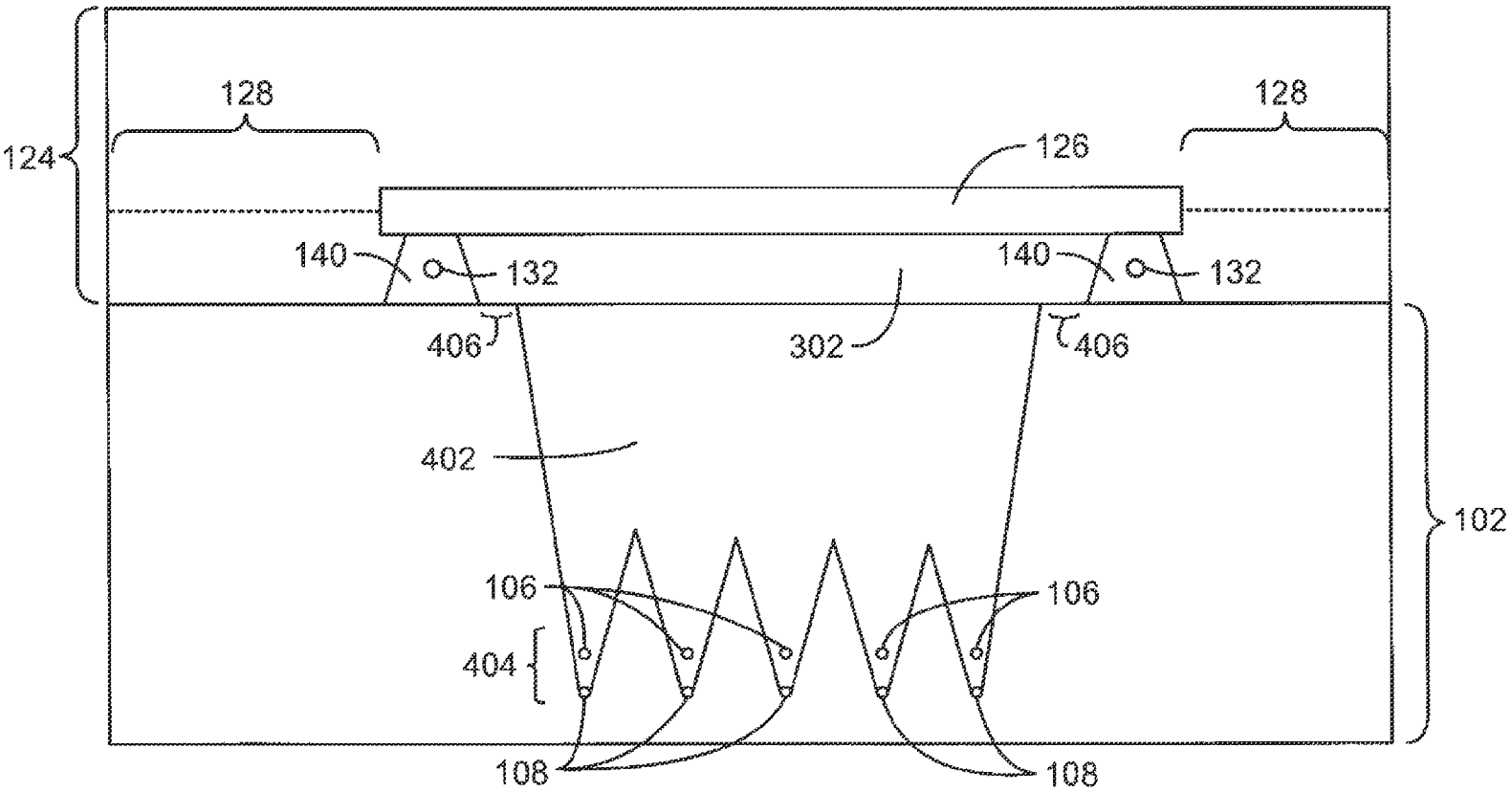
FIG. 4 is a cross sectional view of the hydrocarbon reservoir of FIG. 3, showing the formation of a steam chamber above SAGD well pairs in the reservoir.

FIG. 4 is a cross sectional view 400 of the hydrocarbon reservoir 102 of FIG. 3, showing the formation of a steam chamber 402 above SAGD well pairs 404 in the reservoir 102. Like numbered items are as discussed with respect to FIGS. 1-3. The steam chamber 402 is formed by steam released from the injection wells 106. As noted, if the chamber 302 were to contain water, the steam in the steam chamber 402 would condense, slowing the temperature increase in the steam chamber 402. Thus, the gas in the chamber 302 over the steam chamber 402 lowers the amount of steam needed to raise the temperature of the reservoir 102 for harvesting hydrocarbons. A buffer zone 406 can be utilized to lower the amount of heat reaching the freeze wall 140, protecting the freeze wall 140 from thawing due to the steam.

Figure 5:
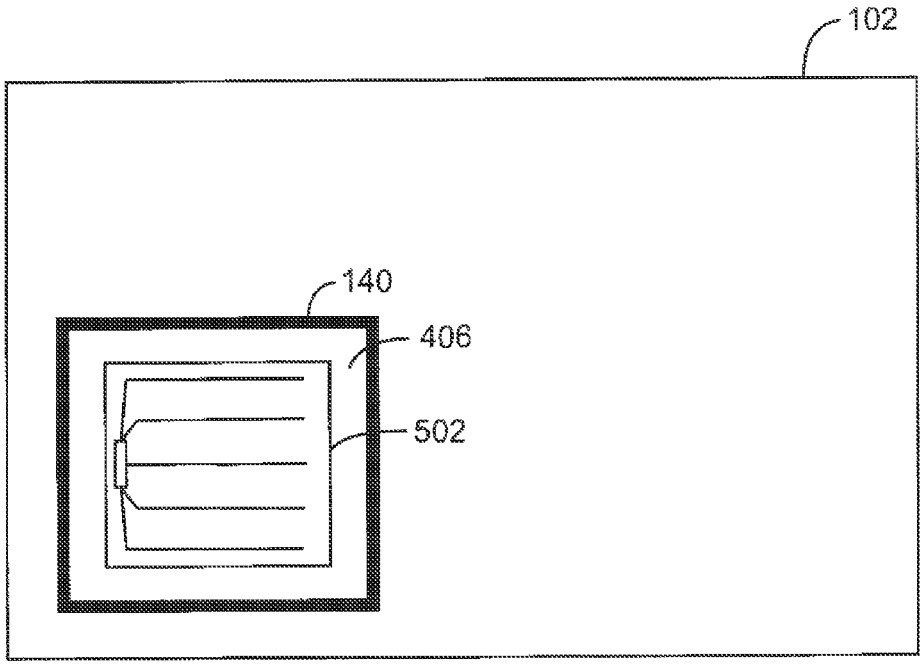
FIG. 5 is a top view of a hydrocarbon reservoir, showing the formation of a freeze wall to isolate a SAGD well pattern from permeable cap rock zones.

FIG. 5 is a top view 500 of a hydrocarbon reservoir 102, showing the formation of a freeze wall 140 to isolate a SAGD well pattern 502 from permeable cap rock zones. Like numbered items are as discussed with respect to FIGS. 1-4. For example, four horizontal cooling wells may be drilled along the periphery of the SAGD patterns 502, wherein each well is under an edge of a contiguous section of the cap rock, and each well overlaps to form a contiguous wall around the patterns. As mentioned, a buffer zone 406 may be formed inside the freeze wall 140 to prevent heat from the SAGD wells from thawing the freeze wall 140. As the initial SAGD patterns 502 are depleted, the freeze wall 140 may be extended.

Figure 6:
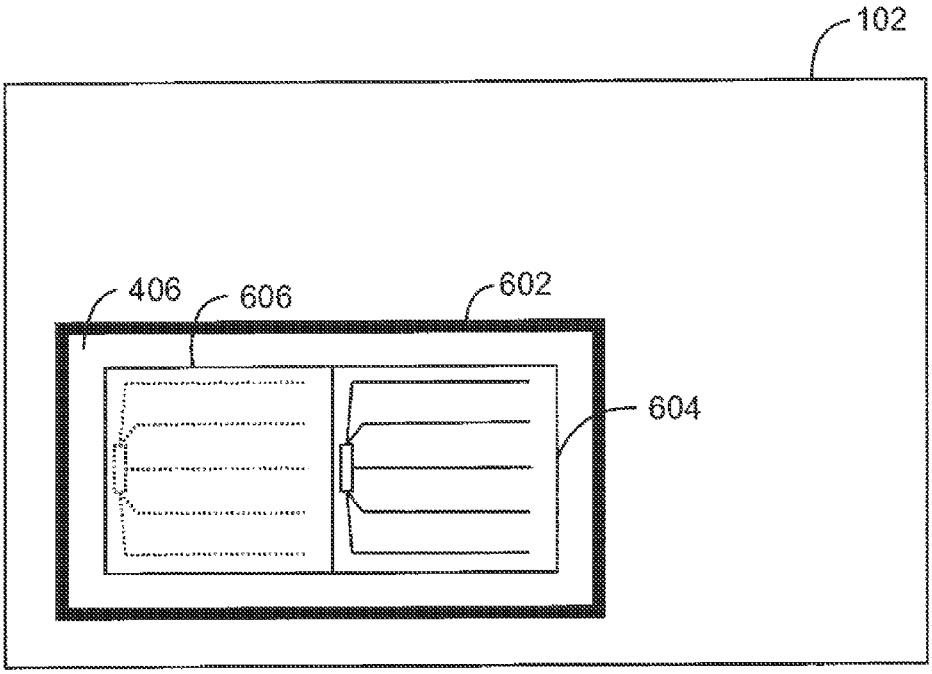
FIG. 6 is a top view of the hydrocarbon reservoir, showing the formation of an extended freeze wall to isolate an adjacent SAGD well pattern from permeable cap rock regions.

FIG. 6 is a top view 600 of the hydrocarbon reservoir 102, showing the formation of an extended freeze wall 602 to isolate an adjacent SAGD well pattern 604 from permeable cap rock regions. Like numbered items are as discussed with respect to FIGS. 1 and 4. In the top view 600 of FIG. 6, an initial SAGD well pattern 606 has been depleted and production has been started from the adjacent SAGD well pattern 604. In this example, the extended freeze wall 602 is formed from the freeze wall 140 of FIG. 5, for example, by drilling extended horizontal wells along the pattern. The use of portions of the initial freeze wall 140 may lower the complexity of forming the extended freeze wall 602. The buffer zone 406 is also extended, protected the new portions of the extended freeze wall 602 from melting.

Figure 7:
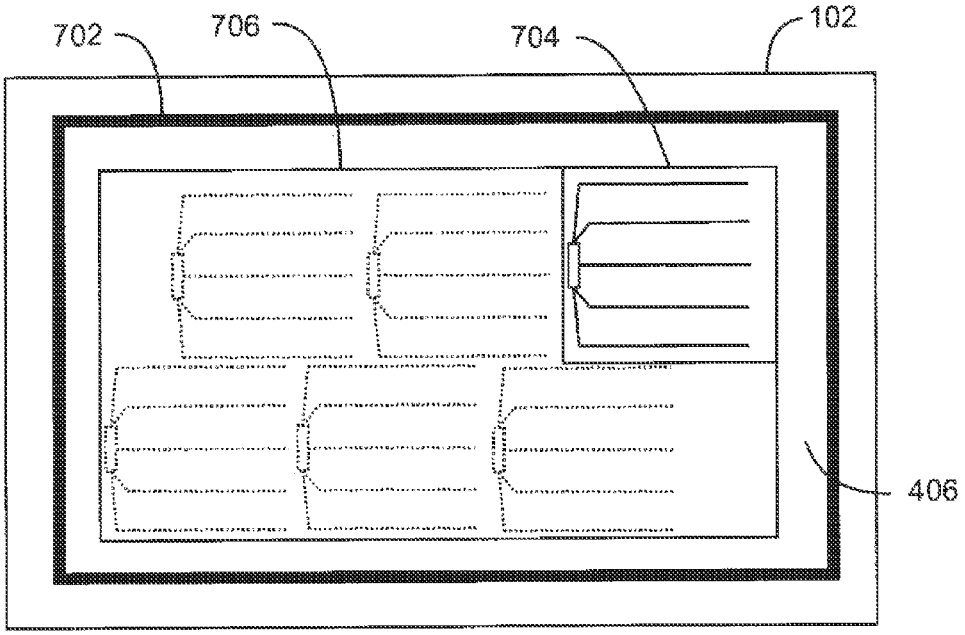
FIG. 7 is a top view of the hydrocarbon reservoir, showing the formation of a final freeze wall to isolate a last SAGD well pattern from permeable cap rock regions.

FIG. 7 is a top view 700 of the hydrocarbon reservoir 102, showing the formation of a final freeze wall 702 to isolate a last SAGD well pattern 704 from permeable cap rock regions. Like numbered items are as described with respect to FIGS. 1 and 4. The extension of the freeze wall 140 from FIG. 5 may be continued across the reservoir 102 as additional patterns are placed into production. For example, the extended freeze wall 702 may encompass a last SAGD pattern 704. Portions of previous freeze walls may be left in place around the depleted SAGD patterns 706 to lower the complexity of forming the final freeze wall 702.

The formation of the freeze walls is not limited to the patterns shown in FIGS. 5-7. Any number of other freeze wall conformations may be used to block an area above a reservoir 102, isolating a leaking or permeable section of cap rock from an intact or contiguous section of cap rock. Such conformations may include freeze walls that are in a single line and isolating a contiguous section of cap rock from a non-contiguous section of cap rock. Further, freeze walls may be formed around a permeable section of cap rock, allowing production from patterns completely surrounding the permeable section of cap rock. Further, depending on the vertical height of the zone to be isolated, the freeze wall may consist of more than one vertically stacked well. Thus, the freeze walls can be a single or a multiple wall (or combination of both), depending on the specific circumstances of the situation being addressed. As an example of this, if the cap rock is tilted, a multiple wall may be used at the higher edge, while no freeze wall may be needed at the lower edge.

In some circumstances, a freeze wall may be used to isolate a lower region of a hydrocarbon reservoir from an upper region of the hydrocarbon reservoir. In this example, the upper region may be harvested by surface mining, which would allow pressure from a SAGD process in a lower region to bleed off, limiting the use of the SAGD. A horizontal freeze wall formed in the aquifer, and extending through the reservoir layer, could block this loss of pressure, allowing both techniques to be used in a single reservoir.

Figure 8:
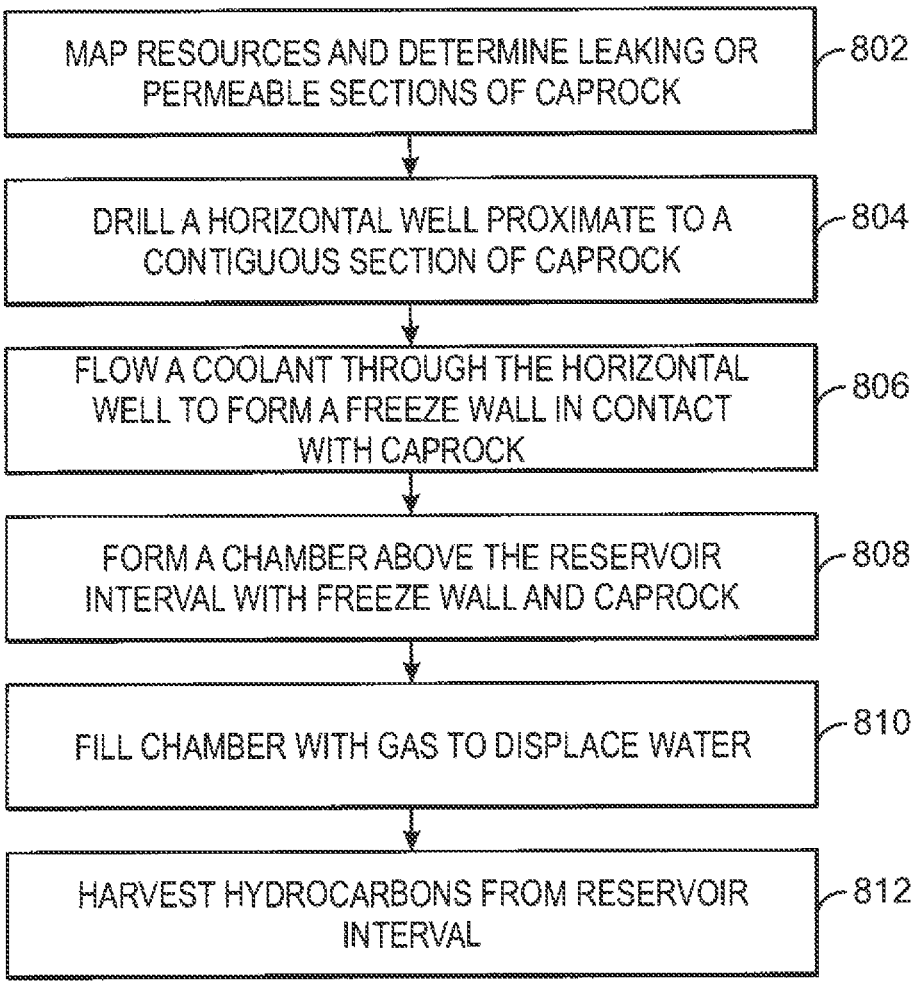
FIG. 8 is a method of improving the harvesting of hydrocarbons from a reservoir by forming a freeze wall over the reservoir.

FIG. 8 is a method of improving the harvesting of hydrocarbons from a reservoir by forming a freeze wall over the reservoir. The method 800 begins at block 802 with a mapping of the locations of resources in a reservoir and a plan for harvesting those resources. The mapping can include locating permeable sections of the cap rock and determining the positions of SAGD patterns around these sections. Generally, the mapping will be performed in the initial planning stages of the recovery scheme. For example, prior to the start of recovery operations, a geologic model can be created for the development area. This geologic model is usually constructed using a geologic modeling software program. Available open hole and cased hole log, core, 2D and 3D seismic data, and knowledge of the depositional environment setting can all be used in the construction of the geologic model. The geologic model and knowledge of surface access constraints can then be used to complete the layout of the recovery process wells, e.g., the horizontal refrigeration wells, the injection wells, the production wells, and the surface pads.

In locating freeze walls, the process needs to consider both the needs of individual well pairs and the overall pattern needs. For example, changes in geology and well design may result in different approaches for different wells within the development. It may also be possible to use simple empirical or analog based models for performance predictions. Further, in many developments, one or more follow-up recovery processes, such as the drilling of in-fill wells, can be used to further enhance the recovery of the hydrocarbons. The options to extend recovery can be considered during the well completion planning phase, in addition to any limitations associated with the freeze wells, such as a geologic region that constrains the buffer region protecting the freeze wells from the injection.

At block 804, the wells, including the horizontal well for forming the freeze wall and the SAGD well pairs used to harvest the hydrocarbon from the reservoir can be drilled. As noted, the horizontal well used for the freeze wall is drilled proximate to a contiguous section of cap rock. Further, multiple layers of horizontal wells may be drilled, if it is determined that the freeze wall should be greater in height or thickness than formed by a single well. After the wells have been drilled, data collected during their drilling as well as data collected during the operation of the recovery process, such as cased hole logs including temperature logs, observation wells, additional time lapse seismic or other remote surveying data, can be used to update the geologic model. This may be used to map the evolution of the depletion patterns as the recovery process matures, indicating new positions for freeze walls as additional SAGD patterns are commissioned.

At block 806, a coolant is flowed through the horizontal wells to form a freeze wall in contact with the cap rock. At block 808, a chamber is formed above the hydrocarbon reservoir by the freeze walls and the cap rock. At block 810, the chamber is filled with a gas, such as air, a hydrocarbon, carbon dioxide, or the like. At block 812 hydrocarbon resources can be harvested from the reservoir using the wells. For example, steam, solvent, or combinations of these agents can be injected into the reservoir through the open screen assemblies along the injections wells. Fluids including hydrocarbons, injectants, water, and the like, can be produced from the production well through the open screen assemblies along the production well.

While the present techniques may be susceptible to various modifications and alternative forms, the embodiments discussed above have been shown only by way of example. However, it should again be understood that the techniques is not intended to be limited to the particular embodiments disclosed herein. Indeed, the present techniques include all alternatives, modifications, and equivalents falling within the true spirit and scope of the appended claims.

Embodiments

Embodiments of the invention may include any combinations of the methods and systems shown in the following numbered paragraphs. This is not to be considered a complete listing of all possible embodiments, as any number of variations can be envisioned from the description above.

1. A method for improving recovery from a subsurface hydrocarbon reservoir, including:

drilling a horizontal well in a zone proximate to a contiguous section of cap rock over a reservoir interval;

flowing a refrigerant through the horizontal well to freeze water in the zone, forming a freeze wall in contact with the contiguous section of cap rock; and forming a chamber above the reservoir interval, wherein the chamber includes the contiguous section of cap rock and at least one freeze wall.

2. The method of paragraph 1, including flowing a gas into the chamber to displace water from the chamber.

3. The method of paragraphs 1 or 2, including:

drilling a plurality of injection wells through the reservoir interval;

drilling a plurality of production wells through the reservoir interval.

4. The method of any of paragraphs 1, 2, or 3, including harvesting hydrocarbons from the reservoir interval.

5. The method of any of the preceding paragraphs, including determining a location for the freeze wall from reservoir data.

6. The method of paragraph 5, wherein the reservoir data includes geologic data, seismic data, open hole log data, or any combinations thereof.

7. The method of paragraph 3, including:

identifying an additional reservoir interval; and expanding the freeze wall to increase the chamber above the additional reservoir interval.

8. The method of any of the preceding paragraphs, including:

drilling a horizontal well along a surface of a cap rock; and flowing a refrigerant through the horizontal well to freeze water in the vicinity of the well, forming a frozen zone.

9. The method of paragraph 8, wherein the frozen zone seals a permeable section of the cap rock.

10. The method of paragraph 8, wherein the frozen zone reinforces the cap rock.

11. The method of any of the preceding paragraphs, including forming a contiguous freeze wall around a permeable section of cap rock.

12. The method of any of the preceding paragraphs, wherein the freeze wall blocks a leak from a permeable zone.

13. The method of any of the preceding paragraphs, including injecting water proximate to the horizontal well, wherein the water is frozen by the refrigerant flow.

14. The method of any of the preceding paragraphs, including forming a freeze wall proximate to a surface mine to prevent leakage into the surface mine.

15. A system for improving the recovery of resources from a reservoir, including:

a horizontal well drilled proximate to a contiguous region of a cap rock; and a coolant system configured to circulate a coolant through the horizontal well, wherein:

the temperature of the coolant is selected to freeze water in the vicinity of the horizontal well, forming a freeze wall;

the freeze wall is in contact with the contiguous region of the cap rock; and the freeze wall and cap rock isolate a chamber above the reservoir from a permeable section of the cap rock.

16. The system of paragraph 15, including two horizontal wells, wherein one horizontal well is an injection well and a second horizontal well is a production well.

17. The system of paragraphs 15 or 16, wherein the coolant includes propane, Freon, water-glycol, or ammonia.

18. The system of any of paragraphs 15, 16, or 17, including a water injection well configured to form a water zone around the horizontal well.

19. A method for harvesting hydrocarbons from an oil sands reservoir, including:

drilling a horizontal well proximate to an impermeable section of a cap rock over the oil sand reservoir;

flowing a refrigerant through the horizontal well to freeze water proximate to the horizontal well, forming a freeze wall in contact with the impermeable section of the cap rock, wherein the freeze wall isolates a permeable section of the cap rock from the impermeable section of the cap rock;

flowing a gas into a chamber formed by the cap rock and the freeze wall to displace water from the chamber;

drilling at least one well through the oil sands reservoir;

injecting steam into the oil sands reservoir; and producing fluids from the oil sands reservoir.

20. The method of paragraph 19, including:

drilling an injection well through the oil sands reservoir, wherein the injection well is configured to flow steam into the oil sands reservoir;

drilling a production well through the oil sands reservoir, wherein the production well is configured to harvest mobilized hydrocarbon from the oil sands reservoir.

21. The method of paragraphs 19 or 20, including forming a freeze wall that substantially surrounds a layer over the oil sands reservoir.

22. The method of any of paragraphs 19-21, including forming a freeze wall that substantially surrounds a permeable region in the cap rock.

23. The method of any of paragraphs 19-22, including forming a freeze wall that seals a permeable region in the cap rock.

24. The method of any of paragraphs 19-23, including forming a freeze wall that provides structural reinforcement to the cap rock.

25. The method of any of paragraphs 19-24, including forming a freeze wall to isolate the oil sands reservoir from an open pit mine.

What is claimed is:

1. A method for improving recovery from a subsurface hydrocarbon reservoir, comprising:

drilling a horizontal well in a zone proximate to a contiguous section of cap rock over a reservoir interval;

flowing a refrigerant through the horizontal well to freeze water in the zone, forming a freeze wall in contact with the contiguous section of cap rock;

forming a chamber above the reservoir interval, wherein the chamber comprises the contiguous section of cap rock and at least one freeze wall; and flowing a gas into the chamber to displace water from the chamber.

2. The method of claim 1, comprising:

drilling a plurality of injection wells through the reservoir interval;

drilling a plurality of production wells through the reservoir interval.

3. The method of claim 2, comprising:

identifying an additional reservoir interval; and expanding the freeze wall to increase the chamber above the additional reservoir interval.

4. The method of claim 1, comprising harvesting hydrocarbons from the reservoir interval.

5. The method of claim 1, comprising determining a location for the freeze wall from reservoir data.

6. The method of claim 5, wherein the reservoir data comprises geologic data, seismic data, open hole log data, or any combinations thereof.

7. The method of claim 1, comprising:

drilling a horizontal well along a surface of a cap rock; and flowing a refrigerant through the horizontal well to freeze water in the vicinity of the well, forming a frozen zone.

8. The method of claim 7, wherein the frozen zone seals a permeable section of the cap rock.

9. The method of claim 7, wherein the frozen zone reinforces the cap rock.

10. The method of claim 1, comprising forming a contiguous freeze wall around a permeable section of cap rock.

11. The method of claim 1, wherein the freeze wall blocks a leak from a permeable zone.

12. The method of claim 1, comprising injecting water proximate to the horizontal well, wherein the water is frozen by the refrigerant flow.

13. The method of claim 1, comprising forming a freeze wall proximate to a surface mine to prevent leakage into the surface mine.

14. A system for improving the recovery of resources from a reservoir, comprising:

a horizontal well drilled proximate to a contiguous region of a cap rock; and a coolant system configured to circulate a coolant through the horizontal well, wherein:

the temperature of the coolant is selected to freeze water in the vicinity of the horizontal well, forming a freeze wall;

the freeze wall is in contact with the contiguous region of the cap rock;

the freeze wall and cap rock isolate a chamber above the reservoir from a permeable section of the cap rock; and a gas cap of injected gas in the chamber.

15. The system of claim 14, comprising two horizontal wells, wherein one horizontal well is an injection well and a second horizontal well is a production well.

16. The system of claim 14, wherein the coolant comprises propane, Freon, water-glycol, or ammonia.

17. The system of claim 14, comprising a water injection well configured to form a water zone around the horizontal well.

18. A method for harvesting hydrocarbons from an oil sands reservoir, comprising:

drilling a horizontal well proximate to an impermeable section of a cap rock over the oil sand reservoir;

flowing a refrigerant through the horizontal well to freeze water proximate to the horizontal well, forming a freeze wall in contact with the impermeable section of the cap rock, wherein the freeze wall isolates a permeable section of the cap rock from the impermeable section of the cap rock;

flowing a gas into a chamber formed by the cap rock and the freeze wall to displace water from the chamber;

drilling at least one well through the oil sands reservoir;

injecting steam into the oil sands reservoir; and producing fluids from the oil sands reservoir.

19. The method of claim 18, comprising:

drilling an injection well through the oil sands reservoir, wherein the injection well is configured to flow steam into the oil sands reservoir;

drilling a production well through the oil sands reservoir, wherein the production well is configured to harvest mobilized hydrocarbon from the oil sands reservoir.

20. The method of claim 18, comprising forming a freeze wall that substantially surrounds a layer over the oil sands reservoir.

21. The method of claim 18, comprising forming a freeze wall that substantially surrounds a permeable region in the cap rock.

22. The method of claim 18, comprising forming a freeze wall that seals a permeable region in the cap rock.

23. The method of claim 18, comprising forming a freeze wall that provides structural reinforcement to the cap rock.

24. The method of claim 18, comprising forming a freeze wall to isolate the oil sands reservoir from an open pit mine.

* * * * *